United States Patent [19]

Streett

[11] Patent Number: 4,652,030

[45] Date of Patent: Mar. 24, 1987

[54] REPAIR SPRING FOR VEHICLE DOOR LATCH/HANDLE ASSEMBLY

[75] Inventor: James T. Streett, Pottstown, Pa.

[73] Assignee: Street Specialty Products Inc., Pottstown, Pa.

[21] Appl. No.: 724,027

[22] Filed: Apr. 17, 1985

[51] Int. Cl.[4] ..... E05C 13/00

[52] U.S. Cl. ..... 292/336.3; 267/51; 292/1; 292/DIG. 31; 292/DIG. 61

[58] Field of Search ..... 267/51; 292/1, 336.3, 292/347, DIG. 31, DIG. 61

[56] References Cited

U.S. PATENT DOCUMENTS

| | | | |
|---|---|---|---|
| 902,250 | 10/1908 | Power | 267/51 |
| 2,237,949 | 4/1941 | Palmer | 292/DIG. 31 X |
| 2,440,350 | 4/1948 | Shafer | 292/DIG. 31 X |
| 2,474,519 | 6/1949 | Drzewiecki | 292/DIG. 31 X |

*Primary Examiner*—Richard E. Moore

*Attorney, Agent, or Firm*—Frederick J. Olsson

[57] ABSTRACT

A leaf spring bent at its midsection to form operating legs spaced about 120° apart. The legs can be compressed together with finger pressure and the spring then inserted over a defective coil spring of Corvette door latch/handle assembly. When fully inserted the spring functions in the same way as the original spring before same became damaged.

3 Claims, 6 Drawing Figures

REPAIR SPRING FOR VEHICLE DOOR LATCH/HANDLE ASSEMBLY

This invention relates in general to vehicle door latch/handle assemblies and particularly to such assemblies which employ a coiled torsion spring which generates the force necessary to maintain the latch on the door handle in engagement with the keeper on the vehicle body.

Such assemblies are employed on Corvette automobiles of the 1969–1982 models. The assemblies employ a latch actuator flap normally held by the pressure of the coil spring in a horizontal position wherein the latch is engaged with keeper but which is tilted downwardly by finger pressure against the spring force to disengage the latch from the keeper and permit the door to be opened. Repeated opening and closing of the doors of these models causes at least one of the operating arms of the coil spring to break off. This results in the flap tilting down about 30° from its normal horizontal position. Although the door will remain closed and can be opened as mentioned above, the downward tilt is objectionable from the aesthetic standpoint, a situation which is not tolerable to most Corvette owners.

Up until the present invention, the only way to eliminate the tilt condition was to purchase a new latch/handle assembly and then replace the defective assembly by removing the inside of the door panel, disengaging the latch drive linkage, unbolting the old assembly, and repeating the process in reverse to install the new assembly. The foregoing is a costly, time consuming process.

The present invention contemplates eliminating the above mentioned condition without replacing the defective assembly. According to the invention, the defect is cured by inserting an especially configured leaf spring over the defective coil spring. This is done on the outside of the vehicle by taking the spring in the fingers, bending same, and pushing the spring into position. The new spring then functions in the same manner as the original spring but without the breakage problem.

The invention will be described below in connection with the following drawing wherein.

Figure 5:
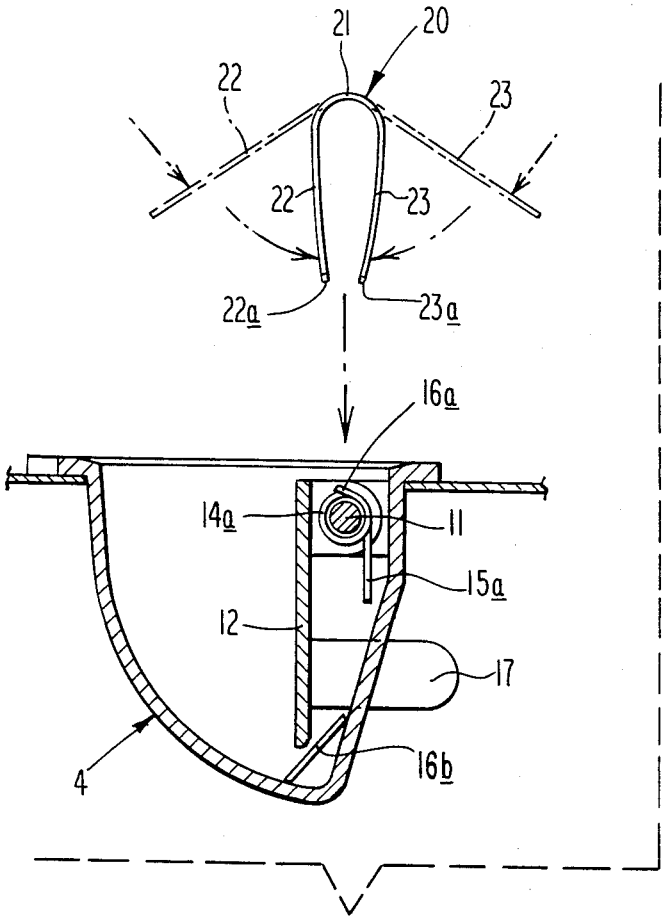
Figure 4:
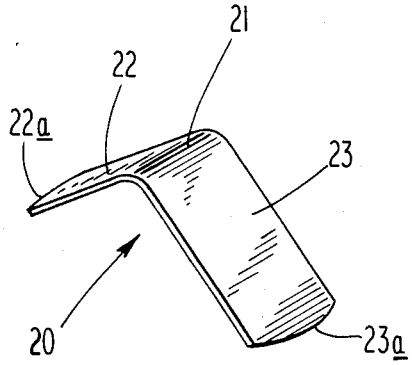
Figure 6:
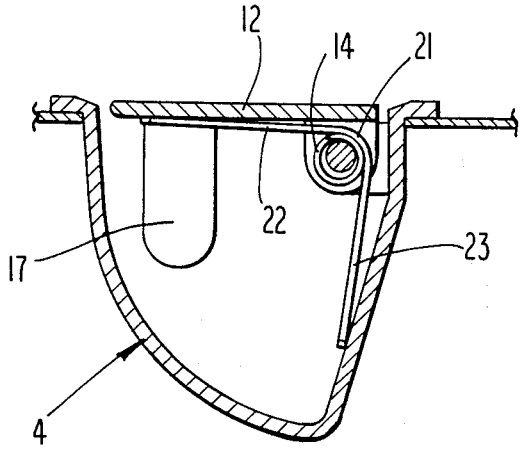

IFIG. 4 is a perspective view of the leaf spring of the invention;

FIG. 5 is an exploded view particularly illustrating the original broken coil spring and also illustrating the leaf spring of FIG. 4 ready to be inserted to effect repair; and FIG. 6 is a view illustrating the leaf spring fully inserted and functioning to place the latch actuator flap in the latched position.

The 1969–1982 Corvette vehicles are designed with a shoulder on the door both on the driver's side and on the passenger side.

Figure 1:
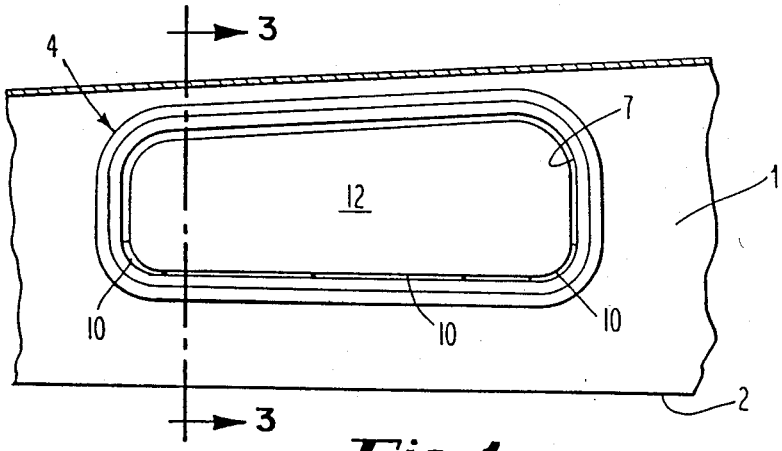
Fig. 1 PRIOR ART
FIG. 1 is a plan view of a latch/handle assembly on the passenger side of the typical 1969–1982 Corvette with the latch actuator flap in latched position, i.e. wherein the latch would be engaged with the keeper.
Figure 2:
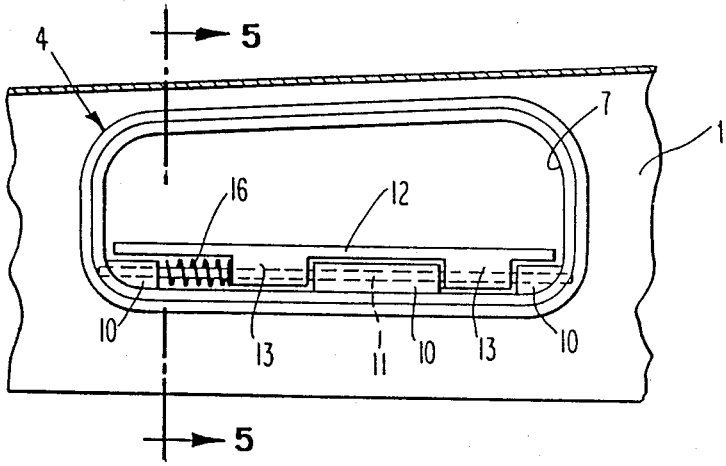
Fig. 2 PRIOR ART
FIG. 2 is a plan view as in FIG. 1 with the latch actuator flap in unlatched position, i.e. wherein the latch would be disengaged from the keeper.
Figure 3:
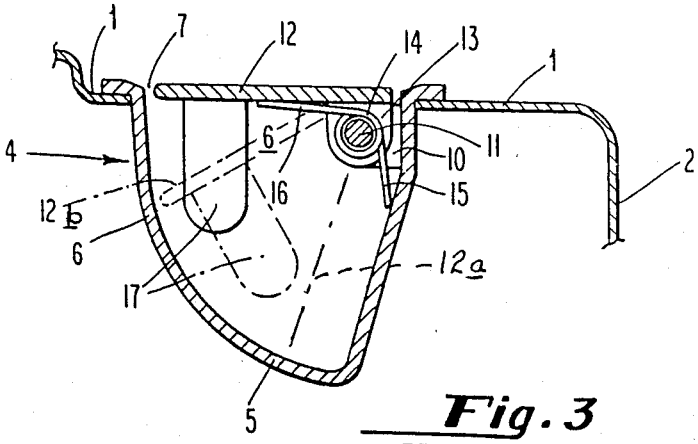
Fig. 3 PRIOR ART
FIG. 3 is a sectional view taken along the lines 3—3 of FIG. 2 and particularly illustrating how the original coil spring functions.

The top of the shoulder is indicated in FIGS. 1, 2, and 3 by the numeral 1. Note in FIG. 3 that shoulder 1 bends down into the door panel 2. The door latch/handle assembly 3 is installed in this shoulder.

The vehicle door latch/handle assembly 3 includes a housing 4 having a bottom wall element 5 and side wall element 6. These elements form a hollow cavity with a top opening 7.

Along one edge of the opening are the standards 10 having clearance holds which mount the pivot pin 11. Normally the ends of the pin are staked over to maintain the pin in position.

The latch actuator flap element is indicated at 12. The flap 12 has a pair of extensions 13 each having a clearance hold receiving the pivot pin 11. This mounts the flap 12 for tilting motion as between (see FIG. 3) the latched position shown by the full lines and the unlatched position shown by the dotted lines.

A wire torsion spring 14 is wound around the pivot pin 11 between the standards 10 and 13. The opposite ends of the spring are respectively formed with operating arms 15 and 16. The arm 15 engages the side element 6 of the housing while the arm 16 engages the underside of the flap 12.

The spring 14 positions the flap 12 in the latched position shown in FIGS. 1 and 3 wherein the flap extends across the opening 7. As noted heretofore, this is the normal position of the flap to maintain the engagement between the latch and keeper.

The flap is held in the latched position of FIGS. 1 and 3 against the force of spring 16 by fingers (not shown) on the extensions 13 which engage the outside of the side wall 6 and prevent the flap from being further rotated upwardly.

The flap 12 has a bracket 17 connected to linkage (not shown) which causes the latch on the door to move into and out of engagement with the keeper on the vehicle body.

To open the door, the fingers contact the top side of the flap 12 (FIG. 3) and press the flap all the way down to the position indicated by the dotted lines **12*a*. This causes the latch and keeper to disengage so that the door can be pulled open. The position shown by the dotted lines 12*a*** is in the unlatched position.

As previously mentioned, it turns out that in the 1969–1982 Corvette cars, repeated opening and closing of the door cause one or both of the operating arms 15 and 16 to snap off, usually at a point closely adjacent the coil. For example, see the broken operating arm **16*a* in FIG. 5. The broken off piece of the arm rests in the bottom of the cavity and is indicated at 16*b***.

When one of the operating arms no longer functions, the flap will drop into the dotted line position **12*b* of FIG. 3**. Rather than replacing the whole latch/handle assembly, the present invention contemplates inserting a leaf spring which will function the same as the original spring except that sections of the spring will not snap off.

The spring of the invention is shown in FIG. 4 and is formed from a flat strip of stainless steel . At the midsection 21, the strip is bent so that the strip is generally U-shaped with legs 22 and 23 extending outwardly. The angle between the legs is preferably around 120°.

The spring 20 is inserted in the defective latch/handle as shown in FIG. 5.

The spring 20 is held in the fingers and inward pressure exerted on legs 22 and 23 to move the legs toward one another as shown in the full lines. The ends **22*a* and 23*a* of the spring are slightly more than the outside diameter of the defective spring 14*a*. This permits the spring 20 to be moved inwardly. The initial amount of movement is such that the ends 22***a* and 23*a* are inwardly just beyond the lower portion of the coil of defective spring 14*a*. Then the flap 12 is held in the down position and the spring 21 pushed in until the bend 21 bottoms on the coil of spring 14*a*.

At that point the flap is released and (FIG. 6) the spring 20 moves the flap to the normal position by that the leg 23 bears on the side element 23 and the leg 21 bears on the underside of the flap 12. In the position of FIG. 6 spring 20 will be compressed so that the angle between the legs 22 and 23 is approximately 90° which generates the force to maintain the flap 12 in the normal position but allowing the flap 12 to be moved down by finger pressure for opening the door.

As noted in FIG. 4, the ends 22*a* and 23*a* of the spring 20 are contoured. This is to aid in the process of inserting the spring as above described.

I claim:

1. In a vehicle door latch and handle assembly:

a housing having a bottom wall element and a side wall element extending outwardly therefrom and forming a cavity with an opening defined by the outer edges of the side wall element;

a pivot pin mounted on one edge of said opening;

a latch actuator flap element connected to the pivot pin for tilting motion from a first position wherein the latch actuator flap extends across said opening and a second position wherein the latch actuator flap extends down into said cavity, the first position being for use in latching the door in its closed position and the second position being for use in unlatching the door so same can be opened;

a wire spring wound around said pivot pin in the form of a coil the opposite ends of the coil formed respectively with operating arms, the normal function of the arms being to respectively engage the inside of said side wall element and the underside of said latch actuator flap element to yieldably retain the flap in said first position;

one of said arms extending away from the coil a distance sufficient to enable the arm to perform its said normal function of engaging one of said elements and the other of said arms extending away from the coil a distance insufficient for the arm to perform its said normal function of engaging the other of said elements, said other arm having been broken off by prior tilting motion of said flap in opening the vehicle door; and a leaf spring formed into the shape of a U, the bend in the U being disposed over said coil and the legs of the U respectively engaging side wall element and the underside of said latch actuator flap element whereby to yieldably maintain said flap in said first position.

2. In combination, a repair leaf spring and a vehicle door latch and handle assembly, the assembly having a housing formed as a cavity with an inside wall, a latch actuator flap, a pivot pin mounting the flap to extend across the cavity, and a defective coil spring wound around said pivot pin, the leaf spring being formed from elongated, flat material bent to form a pair of operating arms extending into said cavity with the bent section engaging said defective coil spring and the arms respectively engaging said inside wall and the underside of said flap for yieldably holding said flap to extend across said cavity.

3. The spring of claim 2 wherein the opposite edges of said operating arms are contoured.

* * * * *